US009046329B2

(12) United States Patent
Blosser et al.

(10) Patent No.: US 9,046,329 B2
(45) Date of Patent: Jun. 2, 2015

(54) FLETCHING SLEEVE SYSTEM AND METHOD OF APPLICATION AND MANUFACTURE

(71) Applicants: Ben D. Blosser, Richland, IN (US); Sean E. Gordon, Tucson, AZ (US)

(72) Inventors: Ben D. Blosser, Richland, IN (US); Sean E. Gordon, Tucson, AZ (US)

( * ) Notice: Subject to any disclaimer, the term of this patent is extended or adjusted under 35 U.S.C. 154(b) by 83 days.

(21) Appl. No.: 13/907,646

(22) Filed: May 31, 2013

(65) Prior Publication Data

US 2014/0357433 A1 Dec. 4, 2014

(51) Int. Cl.
*F42B 6/06* (2006.01)

(52) U.S. Cl.
CPC ..... *F42B 6/06* (2013.01)

(58) Field of Classification Search
CPC ..... F42B 6/06
USPC ..... 473/578, 585, 586
See application file for complete search history.

(56) References Cited

U.S. PATENT DOCUMENTS

| | | | | |
|---|---|---|---|---|
| 2,887,319 | A * | 5/1959 | Lay | 473/586 |
| 3,815,916 | A * | 6/1974 | Meszaros | 473/586 |
| 4,204,307 | A | 5/1980 | Pfetzing | |
| 7,485,057 | B2 | 2/2009 | Afshari | |
| 7,955,201 | B2 | 6/2011 | Harwath et al. | |
| 8,465,384 | B2 * | 6/2013 | Blosser et al. | 473/586 |
| 2011/0015009 | A1 * | 1/2011 | Kozlik et al. | 473/586 |

* cited by examiner

*Primary Examiner* — John Ricci
(74) *Attorney, Agent, or Firm* — Lyman Moulton, Esq.; Moulton Patents, PLLC

(57) ABSTRACT

A disclosed archery fletching sleeve system and method of application and manufacture includes a fletching sleeve configured to frictionally fit onto an arrow shaft. The fletching sleeve defines glue application holes, slots, slits and channels or cavities on an inner surface thereof adjacent the glue holes to draw an applied glue therein via a capillary effect and/or an accordion bellows pumping effect. Additional slots and/or slits allow the sleeve to elastically stretch like an accordion to fit a wide range of arrow shaft diameters. The fletching sleeve also comprises a stretchable corrugated sleeve body having an outer diameter to tangential to an outer surface of a plurality of alternating longitudinal ridges thereon and an inner diameter tangential to an inner surface of a plurality of alternating longitudinal grooves thereon, the inner diameter configured to stretchably fit the arrow shaft having a diameter greater than and/or equal to the sleeve inner diameter.

18 Claims, 15 Drawing Sheets

FLETCHING SLEEVE SYSTEM AND METHOD OF APPLICATION AND MANUFACTURE

CROSS-REFERENCE TO RELATED APPLICATION

This application claims the benefit of the priority date of earlier filed U.S. Non-Provisional patent application Ser. No. 13/615,119, filed Sep. 13, 2012 under the title 'A Fletching System and Method of Application' and earlier filed U.S. Provisional Patent Application Ser. No. 61/535,286, filed Sep. 15, 2011 under the same title for Ben D. Blosser and Sean E. Gordon, each incorporated to herein by reference in its entirety.

BACKGROUND OF THE INVENTION

Vanes can become easily damaged in the field due to collisions with other arrows, target pass through, target misses, etc. Any of these situations may lead to the vane needing replacement. Replacement usually requires a specialized jig, knowledge and skill to replace damaged vanes properly. Therefore, many archers opt to take a damaged arrow to an archery pro shop to have the vanes replaced.

The one piece vane has been around for many years, it has been used on mainly youth style arrows as it is a lower cost method of producing a vane, usually it is a press or friction type fit onto youth arrows. It is easy to use the press or friction type fit for this application due to the consistency in diameter of a certain manufacture's youth arrow. Nobody has successfully marketed a one piece vane to the adult market as there are more variations in diameter of arrows and not a good way to attach the one piece vane to the varying diameters.

Some manufacturers market a piece of shrink tubing that has three conventional vanes glued to it. It is slid onto the arrow and dipped into boiling water where it shrinks and conforms around the arrow. Tests and field use of shrink tubing has indicated there is much room for improving the durability of the heat shrink vane. Also, there is a long felt need for an inherently less expensive alternative.

SUMMARY OF THE INVENTION

The disclosed archery fletching system includes a fletching sleeve configured to fit around an arrow shaft. The sleeve includes a plurality of raised portions and contact portions on an inner surface of the sleeve, the raised portions configured to form cavities together with the arrow shaft for an application of an adhesive there between and the contact portions configured to directly contact the arrow shaft. An archery fletching sleeve is also configured to fit around a commercially available arrow shaft, the sleeve defining at least one adhesive to application portal formed together with the arrow shaft to receive an adhesive during an application thereof onto the arrow shaft. An archery fletching sleeve is yet configured to fit around a commercially available arrow shaft, the sleeve comprising at least one adhesive application portal therein, wherein a ratio of portal area to sleeve surface area is at least one part portal area in 18.4 parts sleeve surface area, the portal(s) configured to receive an adhesive applied to the arrow shaft at the portal(s).

The fletching system and method of application may include a low durometer fletching sleeve configured to frictionally fit onto an arrow shaft. The sleeve defines a plurality of glue application holes and a plurality of channels or cavities on an inner surface of the sleeve adjacent the glue holes.

Glue disposed on the sleeve at the holes is drawn into conduits formed between the channels and/or cavities with the arrow shaft and distributed across the inner surface of the sleeve onto the arrow shaft. Capillary action caused by surface tension and intermolecular forces of adhesion between the glue and the sleeve and the arrow shaft, draws the glue from the holes into the resulting conduits. The fletching sleeve also comprises three vanes formed integrally with the sleeve as one piece. One of the vanes may comprise a recessed surface to receive a sticker flush with the vane and thereby avoid aerodynamic interference. The sticker may be used to decorate the vane or to display identifying and advertising indicia.

The disclosed fletching system also includes a collet application tool comprising two semi-cylindrical finger extensions configured to hold and expand the fletching sleeve as it and the collet are slid over the arrow nock and shaft. The collet tool also includes a substantially rigid body configured orthogonally to the two semi-cylindrical fingers and designed to fit into the palm of a user's hand.

The disclosed archery fletching sleeve with integral vanes configured to fit around an arrow shaft in a fixed position with respect to an end of the shaft with a nock, comprises a ratio of an area of an adhesive applied to the sleeve adjacent the arrow shaft to be one part in at least 18.4 parts sleeve surface area. Furthermore, a ratio of portal area to sleeve surface area is one part in at least 110 parts sleeve surface area, the portal(s) configured to receive an adhesive applied to the arrow shaft at the portal(s).

The disclosed archery fletching sleeve also comprises a stretchable corrugated sleeve body having an outer diameter tangential to an outer surface of a plurality of alternating longitudinal ridges thereon and an inner diameter tangential to an inner surface of a plurality of alternating longitudinal grooves thereon, the inner diameter configured to be variable to stretchably fit the arrow shaft having a diameter greater than and/or equal to the sleeve inner diameter.

Other aspects and advantages of embodiments of the disclosure will become apparent from the following detailed description, taken in conjunction with the accompanying drawings, illustrated by way of example of the principles of the disclosure.

Figure 1:
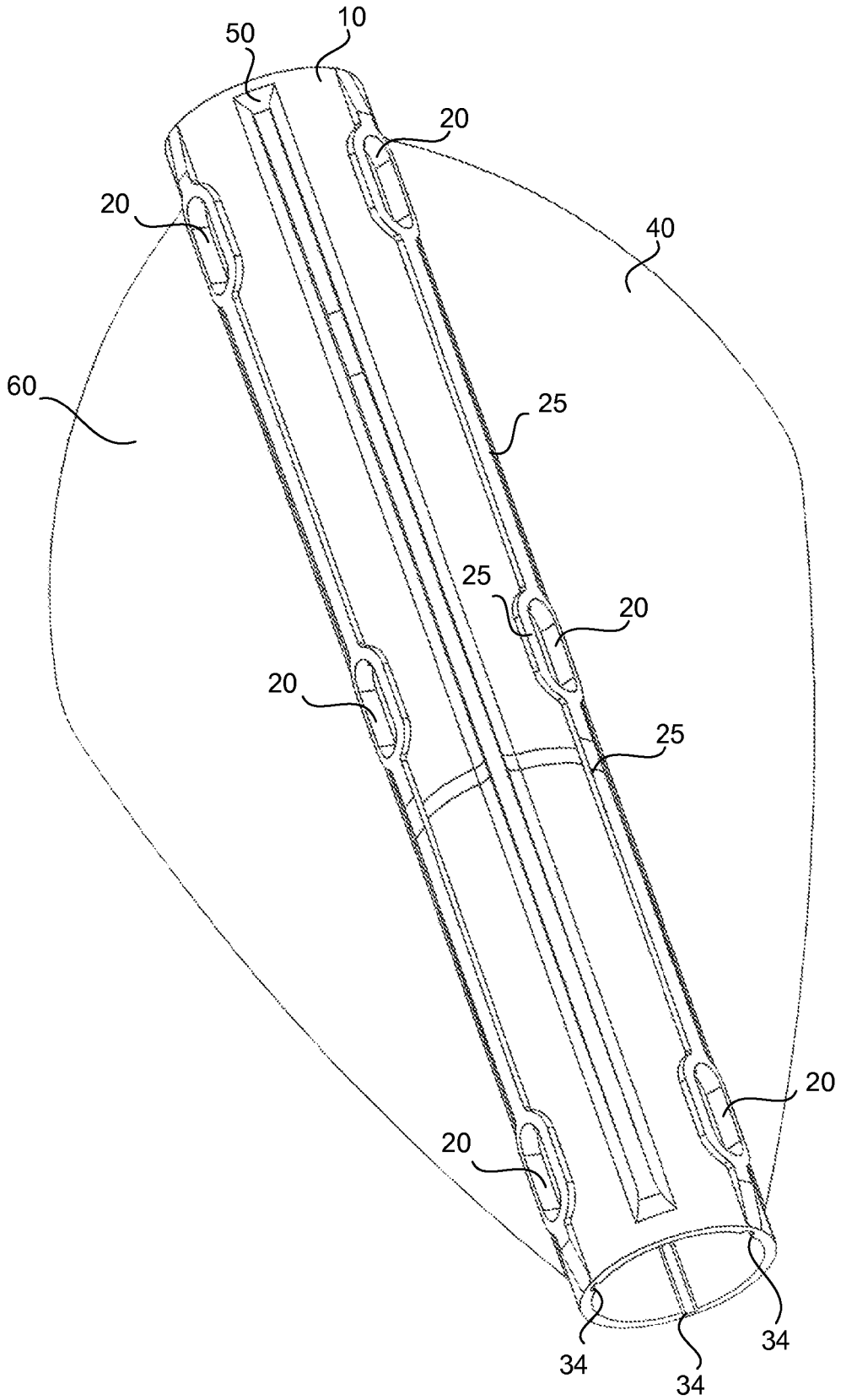
FIG. 1 depicts a perspective view of a straight channel fletching sleeve in accordance with an embodiment of the present disclosure.

Throughout the description, similar or same reference numbers may be used to identify similar or same elements in the several embodiments and drawings. Although specific embodiments of the invention have been illustrated, the invention is not to be limited to the specific forms or arrangements of parts so described and illustrated. The scope of the invention is to be defined by the claims appended hereto and their equivalents.

DETAILED DESCRIPTION

Reference will now be made to exemplary embodiments illustrated in the drawings and specific language will be used herein to describe the same. It will nevertheless be understood that no limitation of the scope of the disclosure is thereby intended. Alterations and further modifications of the inventive features illustrated herein and additional applications of the principles of the inventions as illustrated herein, which would occur to one skilled in the relevant art and having possession of this disclosure, are to be considered within the scope of the invention.

The disclosed fletching system and method of application make replacement or original installation of arrow vanes much easier, faster and economical. The present disclosure enables the serious archer to quickly and inexpensively repair damaged vanes in the field without boiling water to shrink wrap a replacement sleeve or otherwise performing laborious and time consuming procedures.

Throughout the present disclosure and continuances and/or divisional disclosures thereof, the terms 'slot,' 'channel' and 'conduit' may be used interchangeably to define a passageway for a glue from a source to a destination in the passageway formed with an arrow shaft. However, the term 'channel' generally refers to a 360 degree enclosed passage way resulting from an open slot disposed adjacent an arrow shaft. The term 'cavity' used throughout may define an empty space of various sizes and shapes that comprise open and/or closed hole square, rectangular, circular and elliptical cross-sectional geometries and also slots, channels and conduits. Also, the term 'vane' or 'fletching' used throughout to may define a structure which directs or channels airflow over an arrow shaft or between vanes and may not resist or impede an airflow over the arrow nor affect its flight there through unless arranged specifically to do so. The term 'hole' refers to an opening or orifice defined by a 360 degree structure of the fletching sleeve. The term 'portal' is defined by two or more structures together which form an opening or orifice for a passageway in the fletching sleeve such as a portal formed at the end of a channel formed by a slot and the arrow shaft. The term slot and slit may be used interchangeably depending on the context of an embodiment where a very narrow slot may also be referred to as a slit and a less narrow slit may be referred to as a slot.

FIG. 1 depicts a perspective view of a straight channel fletching sleeve in accordance with an embodiment of the present disclosure. The depiction includes a fletching sleeve 10, glue portals 34 formed at the end of a fletching sleeve by a slot or channel therein, glue holes 20, raised sleeve portions 25 also known as raised rib portions or protrusions, raised portion slots 30 on an underside of the sleeve 10, a first vane 40, a second vane 50 and a third vane 60. The fletching sleeve 10 may define at least two or three glue application holes 20 disposed between any two vanes and therefore a total of 9 or more glue holes. The fletching sleeve 10 may include three vanes formed integrally with the sleeve as one piece extruded or injection molded. Though the three vanes 40, 50 and 60 are depicted as in-line with a longitudinal axis of the sleeve, alternate embodiments may include vanes formed offset with the longitudinal axis of the sleeve as depicted below in FIG. 2.

The low durometer fletching sleeve 10 is configured to frictionally fit on an arrow shaft (not depicted). The sleeve comprises a low durometer material having some memory of shape and form and some elastic restoring force to its original cross section to accommodate varying arrow shaft diameters. Embodiments of the fletching sleeve may also be made to varying lengths to allow vanes of varying lengths to be formed thereon. The sleeve defines a plurality of glue application holes and a plurality of channels or cavities on an inner surface of the sleeve 10 adjacent the glue holes 20 and concentric with the glue holes in an embodiment of the disclosure. The channels 30 form conduits with the arrow shaft to for glue applied at the holes 20 when the fletching sleeve is disposed on the arrow shaft. Glue disposed on the sleeve 10 at the holes 20 is drawn into the resulting conduits and distributed between the holes and across the inner surface of the sleeve and the arrow shaft. Capillary action caused by surface tension and intermolecular forces of adhesion between the glue and the sleeve 10 and the arrow shaft, draws the glue from the holes 20 into the resulting conduits.

The height h or the length of a glue column in a fletching sleeve conduit may be given by:

$$h = \frac{2\gamma\cos\theta}{\rho g r},$$

where $\gamma$ is the liquid-air surface tension (force/unit length), $\theta$ is the contact angle, $\rho$ is the density of liquid (mass/volume), g is local gravitational field strength (force/unit mass), and r is the radius of the conduit (length). For water-based glues applied to the fletching sleeve under standard conditions, $\gamma$=0.0728 N/m at 20° C., $\theta$=20° (0.35 rad), $\rho$ is 1000 kg/m$^3$, and g=9.8 m/s$^2$. Cyanoacrylate glues may have a slightly higher density factor of approximately 1.1 times the density of water. Accordingly, the height or length of the glue column between the fletching sleeve and the arrow shaft may be approximated as:

$$h \approx \frac{1.4\times10^{-5}}{r}\ \text{m}.$$

In a 10 one-thousandths of an inch diameter tube (radius 0.0049 in), the glue may travel 1.75 inches through a sleeve-shaft conduit or nearly nine-tenths of an inch through a one-thousandths of an inch sleeve-shaft conduit. The channels 30 are therefore formed approximately 5 to 10 thousandths of an inch in depth and width in the inner surface of the fletching sleeve 10 and extend from a first end of the sleeve to a second end of the sleeve and have a length nominally (1.75 inches) 44.5 mm including one of a ten percent plus and a ten percent minus manufacturing tolerance.

An embodiment of the disclosure may include a constant outside to diameter of the sleeve 10 and a portion of the sleeve thinner over the cavities in relation to the rest of the sleeve 10. A portion of the sleeve over the cavities, slots or slits may also form a raised rib portion 25 also known as a protrusion or even a wrinkle on an outside surface of the sleeve 10 in order to maintain a constant thickness of the sleeve 10 over the cavities. The raised rib portion 25 may extend to a glue hole 20 and form a raised annular or donut circumference around the glue hole 20. Therefore, a raised portion 25 on an outside diameter of the fletching sleeve 10 may include a raised rib portion 25 and an annular portion 25 around each glue hole 20 to which the rib 25 extends. Cavities may form a plurality of slots 30 on an inner surface of the sleeve, the slots configured to interconnect a plurality of glue holes 20 defined in the sleeve, the slots 30 configured to form channels with the arrow shaft and draw a glue applied to the holes 20 through the slots via a capillary action in the channels formed with the arrow shaft. A further embodiment may include the slots 30 configured to be parallel with an elongate axis of the sleeve, the slots 30 configured to form a plurality of stretch sutures between a sleeve portion above each slot and another portion of the sleeve, the stretch sutures configured to lower an overall stretch resistance of the sleeve 10 to facilitate an application of the sleeve onto the arrow shaft. Cavities may also form a plurality of circumferential slots (not depicted) on the inner surface of the sleeve 10, the circumferential slots concentric with a center defined in the sleeve. The cavities may form a plurality of slots on an inner surface of the sleeve wherein the slots comprise a depth of (5 thousandths of an inch) 0.13 mm to (10 thousandths of an inch) 0.25 mm and a width of (one thousandths of an inch) 0.03 mm. In yet another embodiment of the disclosure, cavities may form a plurality of slots on an inner surface of the sleeve wherein the slots comprise one configuration of substantially orthogonal internal vertices and another semi-circular configuration with no vertices and any other slot-like configuration.

Figure 2:
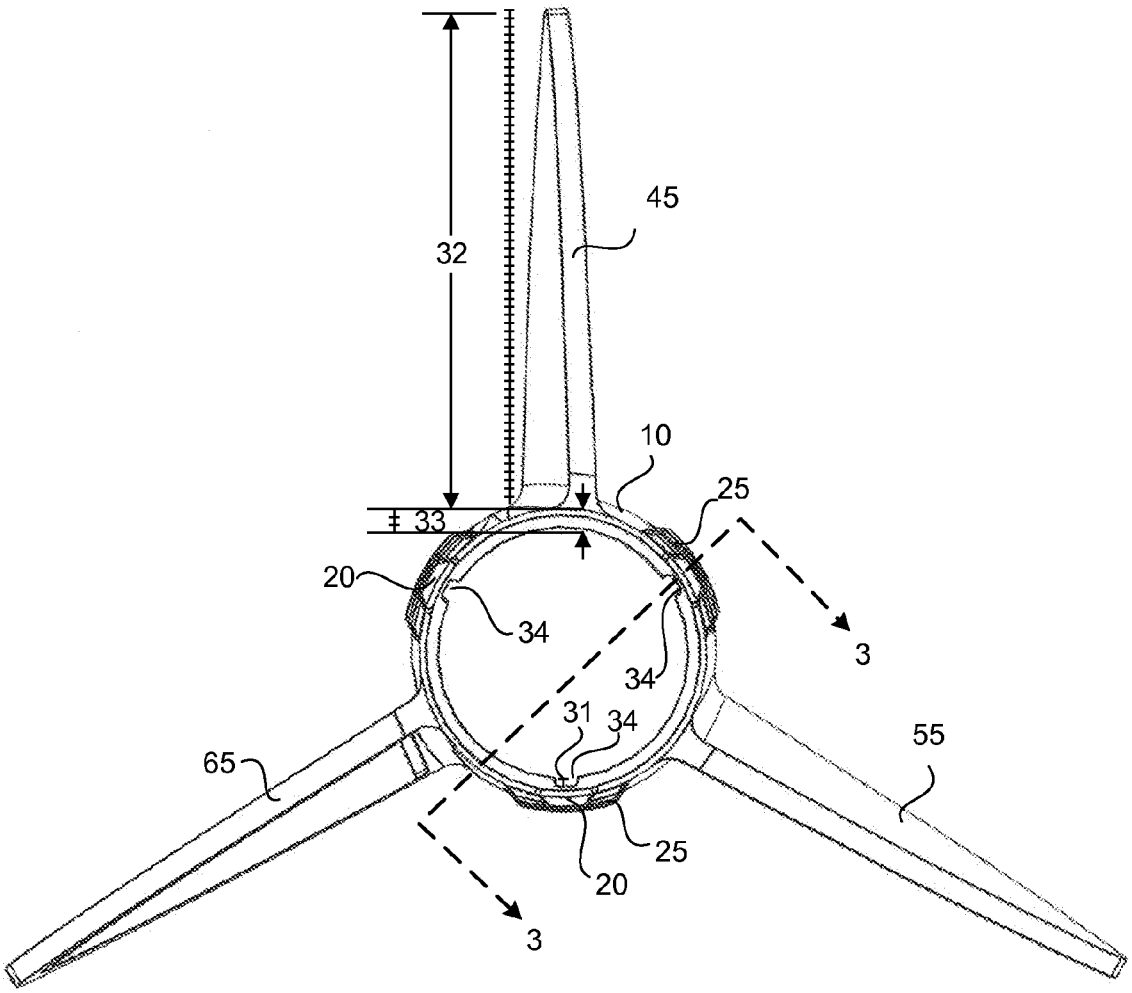
FIG. 2 depicts an end elevational view of a straight channel fletching sleeve in accordance with an embodiment of the present disclosure.
Figure 3:
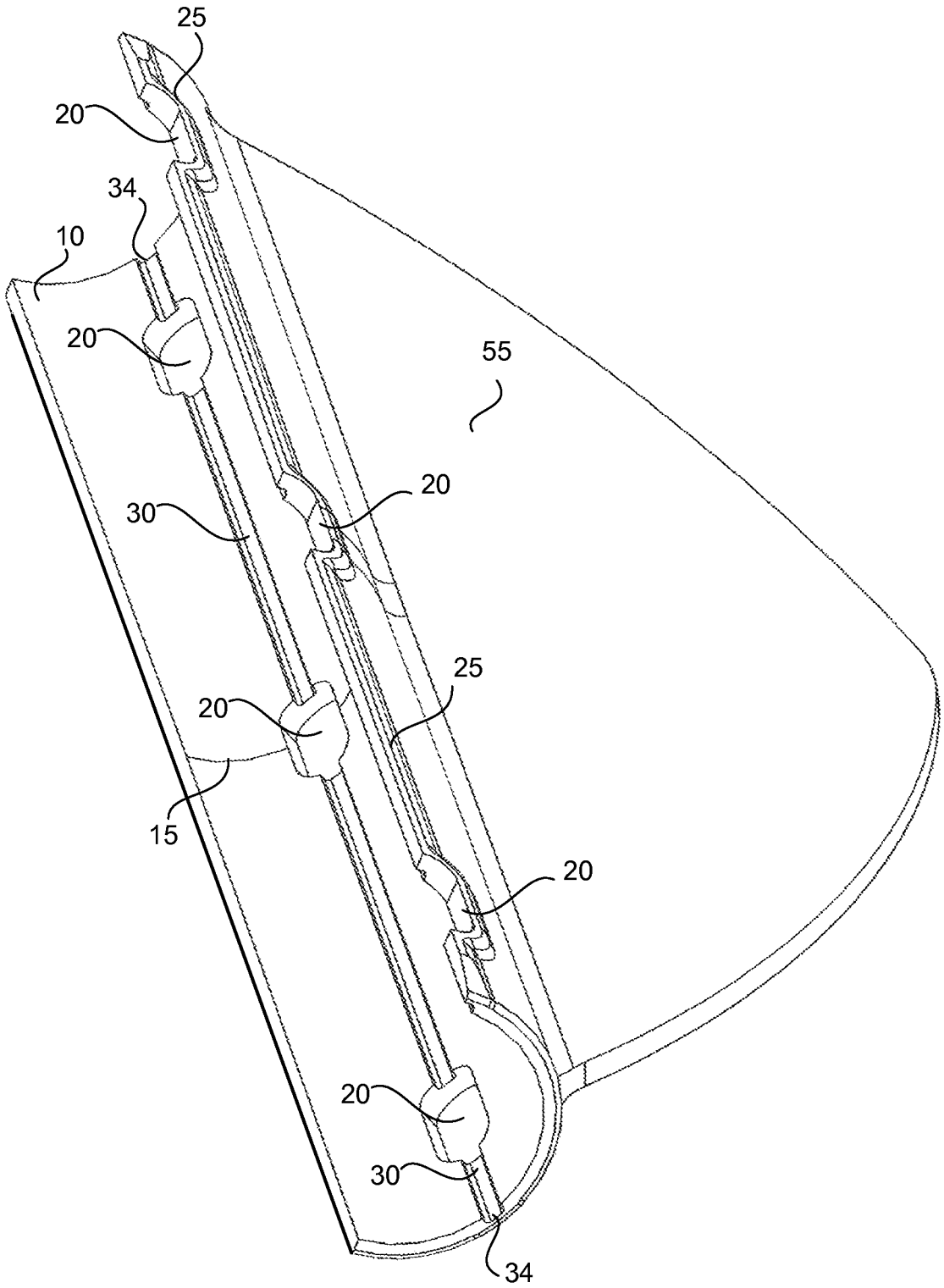
FIG. 3 depicts the cross sectional view 3-3 taken lengthwise through the fletching sleeve of FIG. 2 in accordance with an embodiment of the present disclosure.

FIG. 2 depicts an end elevational view of a straight conduit fletching sleeve in accordance with an embodiment of the present disclosure. The depiction shows the fletching sleeve 10, the glue holes 20, raised portions 25 and the straight channels 30 and glue portals 34 formed at the end of a fletching sleeve by a slot or channel therein. The cross section 3-3 taken lengthwise through the fletching sleeve is depicted in FIG. 3 as described below. The fletching sleeve 10 to also comprises three vanes formed integrally with the sleeve as one piece. It may be noticed that the three vanes 45, 55 and 65 are offset from an elongate axis on the sleeve and therefore may impart a slight aerodynamic spin to the arrow when in flight. Embodiments of the present disclosure also include vanes formed in-line with an elongate axis on the sleeve imparting no aerodynamic drag or airflow resistance or spin to the arrow in flight. Dimensions 31, 32 and 33 indicate relative heights of the slot or channel 30 to a respective height of a vane and a respective height or thickness of the fletching sleeve as depicted. Therefore, using the slot or channel height 31 as a relative unit of measure, the vane height is 60 units tall and the sleeve height or sleeve thickness is 3 units tall or thick. Therefore, ratios of the height of the slot or height of the channel from the arrow shaft are respectively determined to be 1 part slot or channel height to 60 parts vane height (taken from the outer circumference of the sleeve to the tallest portion of a vane) and 1 part slot/channel height to 3 parts sleeve height/thickness as depicted.

An embodiment of the disclosure includes at least one adhesive application portal(s) including raised portions 25 configured to protrude above an outside diameter of the sleeve 10 and receive and contain the adhesive for application onto the arrow shaft. An adhesive application portal also known as a glue hole 20 may extend any length, radius and shape in the sleeve and be joined by a plurality of glue slots of any length formed on an inside of the fletching sleeve running longitudinally, radially and any direction from one of a portal to another portal and to a slot dead-end.

FIG. 3 depicts the cross sectional view 3-3 taken lengthwise through the fletching sleeve of FIG. 2 in accordance with an embodiment of the present disclosure. The depiction shows the fletching sleeve 10, the core pin abutment line 15, the glue holes 20, raised portions 25 and the straight channels 30 formed on the inside of the fletching sleeve and adjoining three glue holes each and glue portals 34 formed at the end of a fletching sleeve by a slot or channel therein. The channels 30 as depicted are each formed in a straight line parallel with an elongate axis of the sleeve. The channels may be configured to form a stretch suture between the resulting thinner sleeve above each channel and the thicker portions of the sleeve. The stretch sutures therefore may lower the overall stretch resistance of the sleeve to facilitate application of the sleeve onto the arrow shaft.

Figure 4:
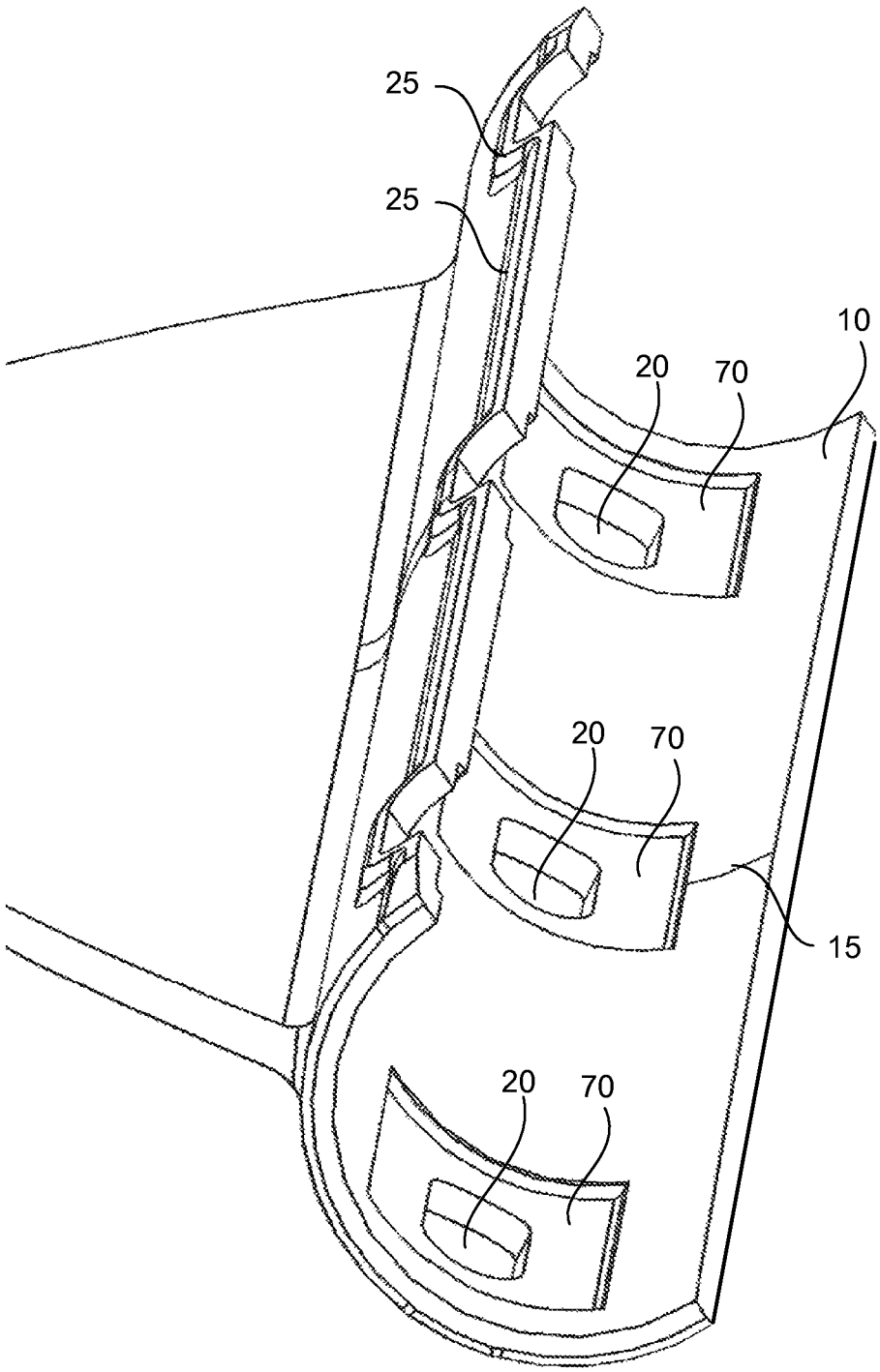
FIG. 4 depicts a perspective view of a cross section taken lengthwise through a fletching sleeve in accordance with an embodiment of the present disclosure.

FIG. 4 depicts a perspective view of a cross section taken lengthwise through a fletching sleeve in accordance with an embodiment of the present disclosure. The depiction shows the fletching sleeve 10, the core pin abutment line 15, the glue holes 20, raised portions 25 and raised portion cavities 70 adjacent the glue holes 20 formed on the inside of the fletching sleeve. The cavities draw glue from the holes much the same way that the channels draw glue from the holes. The cavities are therefore also formed at a depth and width of 5 to 10 one thousandths of an inch. The cavities may be formed in embodiments of the disclosure in place of or in addition to the channels in order to increase the bonding surface area between the fletching sleeve 10 and the arrow shaft. The cavities shown are depicted as square or rectangular but embodiments of the disclosure include circular, oblong and any other geometrical or random shape.

In embodiments of the present disclosure, cavities 70 may be configured to form a stretch area between a sleeve area above each cavity and another area of the sleeve, the stretch areas configured to lower an overall stretch resistance of the sleeve 10 to facilitate an application of the sleeve 10 onto the arrow shaft. A plurality of glue holes 20 may be defined in the sleeve wherein a cavity 70 is formed one of adjacent a glue hole and formed concentric with a glue hole an outside surface of the fletching sleeve 10 adjacent the holes 20 may be slightly raised as depicted by 25. A thickness of the sleeve may also be constant and a portion of the sleeve may be thinner over the cavities in relation to the rest of the sleeve. Therefore the cavities may form a stretch area between the resulting thinner sleeve adjacent a glue hole and the thicker portions of the sleeve.

Figure 5:
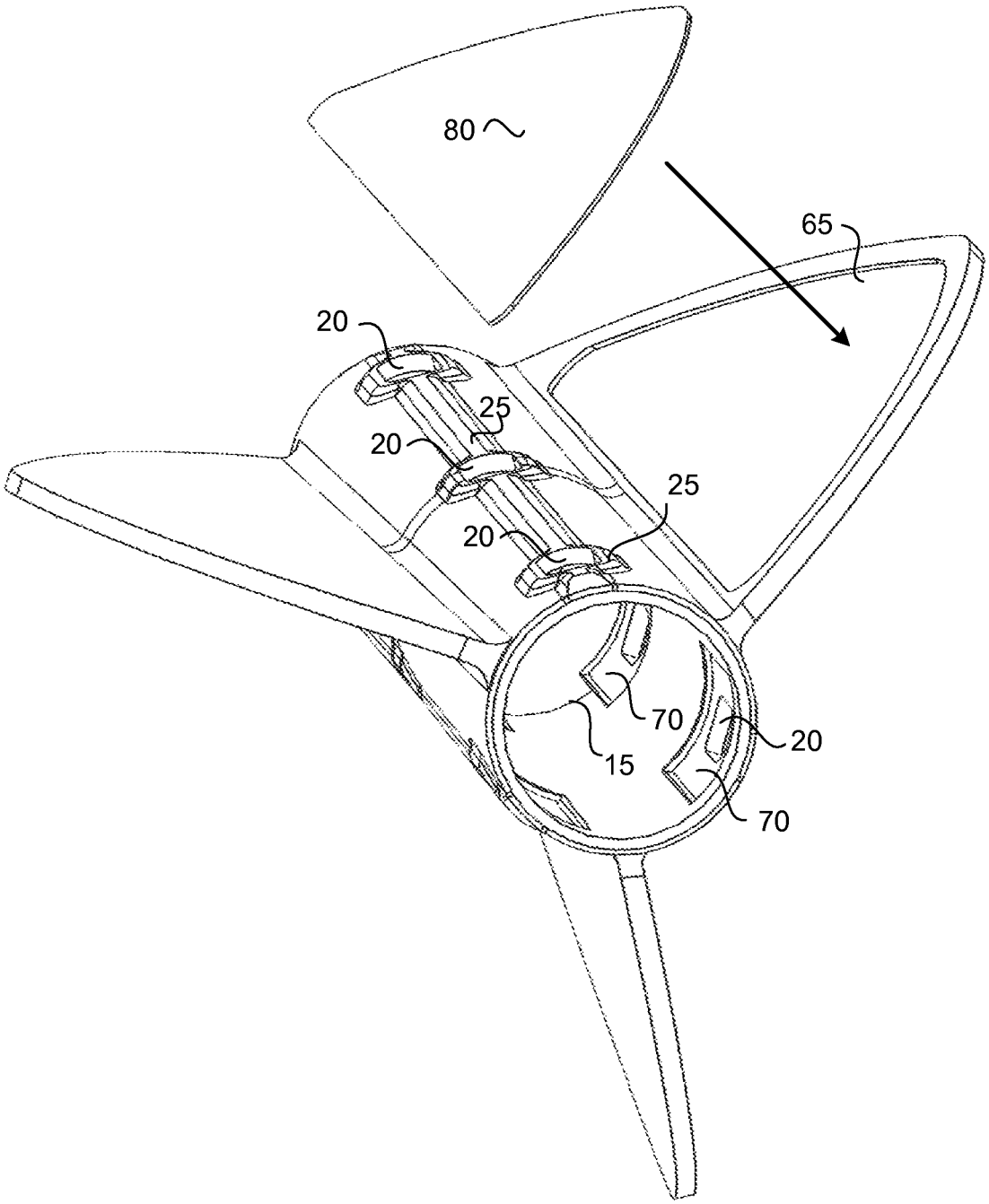
FIG. 5 depicts a perspective view of a geometric cavity fletching sleeve including a recessed vane in accordance with an embodiment of the present disclosure.

FIG. 5 depicts a perspective view of a geometric cavity fletching sleeve including a recessed vane in accordance with an embodiment of the present disclosure. The depiction includes the fletching sleeve 10, the core pin abutment line 15, glue holes 20, raised portions 25, a recessed vane 65, geometric cavities 70 and a sticker 80. The sticker 80 fits into the recess in the vane 65 to be flush with the non-recessed surface and avoid aerodynamic interference with the sticker 80. The sticker may be used to decorate the vane and display identifying or advertising indicia. Though only one vane is depicted with a recess, embodiments include recesses for all three or more vanes.

An archery fletching sleeve 10 as disclosed may comprise at least one adhesive application portal or glue hole 20 therein, wherein a ratio of portal area to sleeve outside surface area is at least one part portal area in 18.4 parts sleeve surface area, the portal(s) configured to receive an adhesive applied to the arrow shaft at the portal(s). Embodiments of the disclosure may include a ratio of an area of the adhesive applied to the arrow shaft at the portal(s) 20 to be at least one part in 18.4 parts sleeve surface area.

Figure 6:
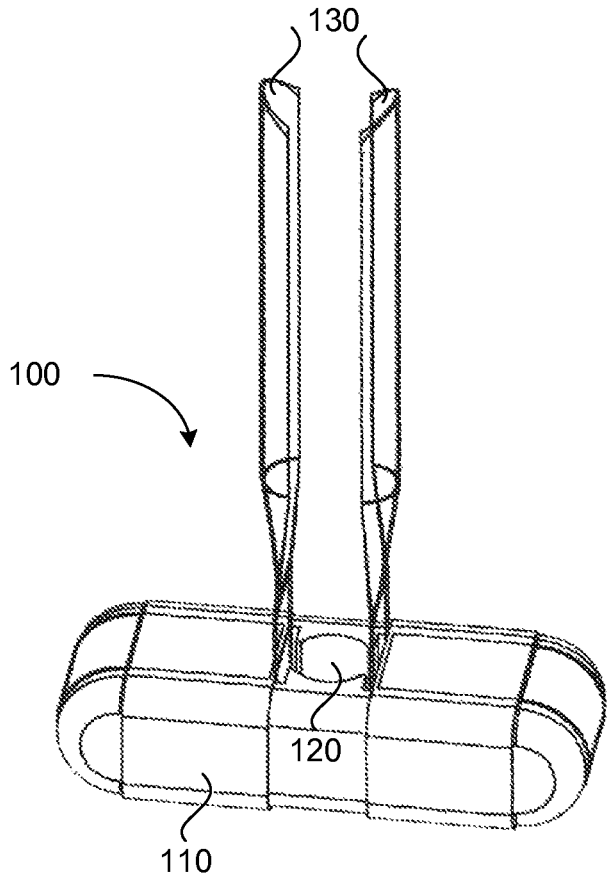
FIG. 6 depicts a perspective view of a collet sleeve applicator in accordance with an embodiment of the present disclosure.

FIG. 6 depicts a perspective view of a collet sleeve applicator in accordance with an embodiment of the present disclosure. The collet sleeve applicator includes a handle 110, a hole 120 formed in the handle and the two semi-cylindrical finger-like extensions 130 disposed axially to the hole 120. Tips of the finger extensions may be chamfered and otherwise configured to be easily received into an inside diameter of a fletching sleeve. The body of the collet-like applicator may be formed into a handle configured orthogonally to the two semi-cylindrical fingers designed to fit into the palm of a user's hand. The collet applicator may be formed from at least one of a polycarbonate material, a metallic material and any other substantially rigid material.

Figure 7:
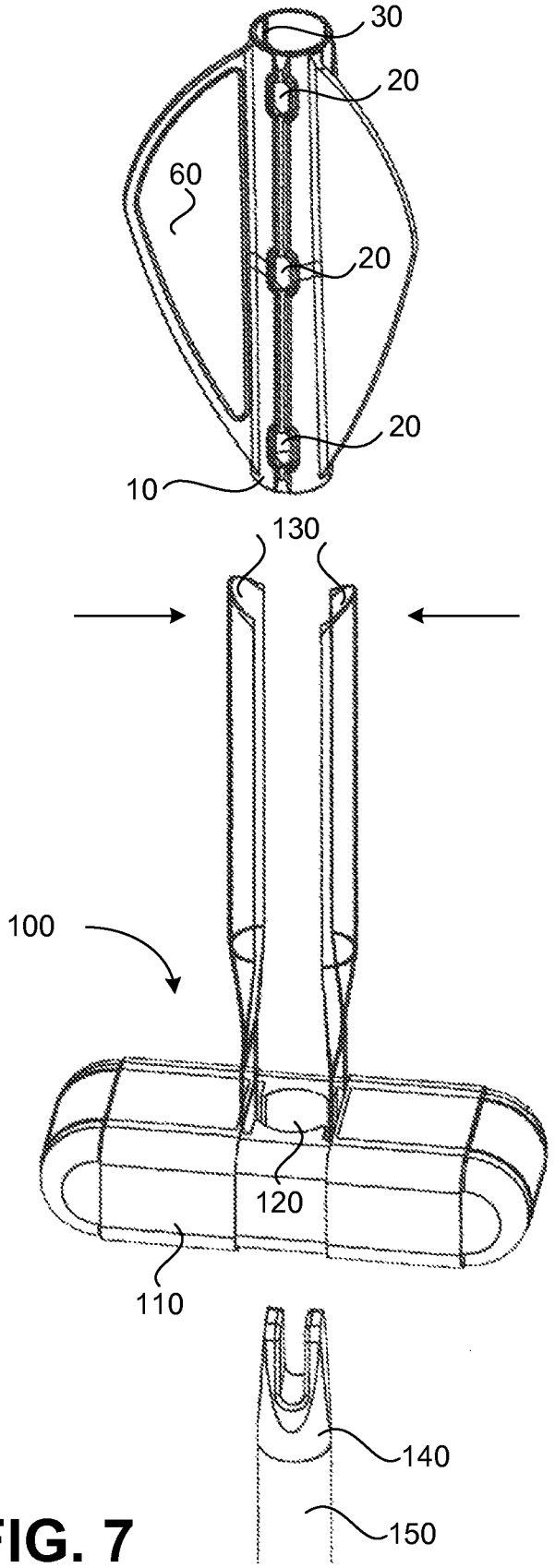
FIG. 7 depicts a perspective view of a fletching system in accordance with an embodiment of the present disclosure.

FIG. 7 depicts a perspective view of a fletching system in accordance with an embodiment of the present disclosure. The system includes the fletching sleeve 10 and the collet applicator 100. The arrow nock 140 and the arrow shaft 150 are typical of commercially available arrows. The finger extensions 130 of the collet applicator 100 are configured to deflect inwardly as indicated by the two opposing arrows to fit an inside diameter of a fletching sleeve 10. A length of the two finger extensions 130 may approximate the length of a fletching sleeve. A diameter of the collet applicator hole 120 may approximate most commercially available arrow nocks and shafts.

Figure 8:
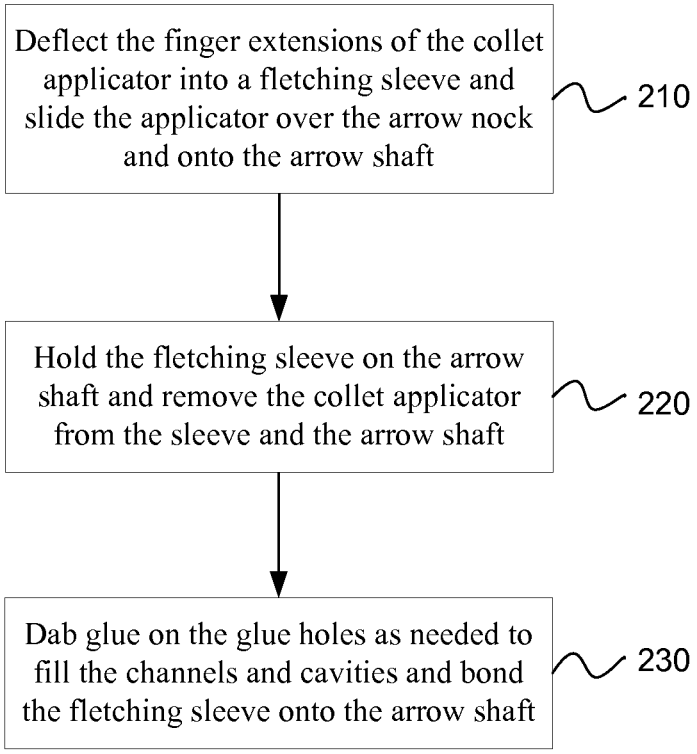
FIG. 8 depicts a flow chart of a method of application of the fletching sleeve using the fletching system in accordance with an embodiment of to the present disclosure.

FIG. 8 depicts a flow chart of a method of application of the fletching sleeve using the fletching system in accordance with an embodiment of the present disclosure. The method includes 210 deflecting the collet applicator fingers 130 into a fletching sleeve and sliding the collet applicator over the arrow nock and onto the arrow shaft. The method also includes 220 holding the fletching sleeve on the arrow shaft and removing the collet applicator from the sleeve and the arrow shaft. The method additionally includes 230 dabbing glue on the glue to holes as needed to fill the channels and cavities and bond the fletching sleeve onto the arrow shaft.

Figure 9:
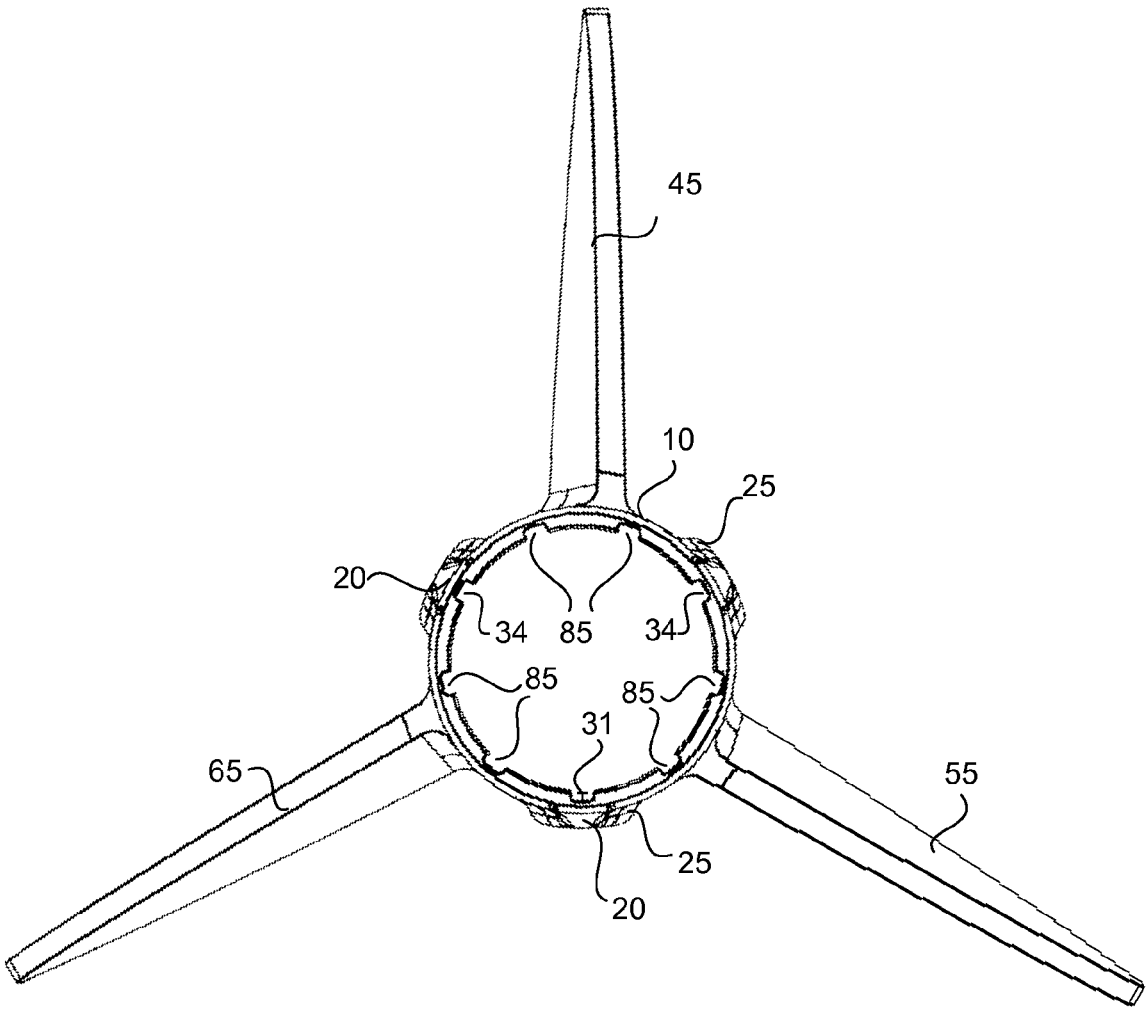
FIG. 9 depicts an end elevational view of an archery fletching sleeve including 6 slots in addition to 3 glue channels in accordance with an embodiment of the present disclosure.

FIG. 9 depicts an end elevational view of an archery fletching sleeve including 6 slots in addition to 3 glue channels in accordance with an embodiment of the present disclosure. With the exception of the slots 85, reference numbers similar or same to reference numbers in other drawings are used to identify similar or same elements as also described in supporting descriptions. An archery fletching sleeve with integral vanes configured to fit around an arrow shaft in a fixed position with respect to an end of the shaft with a nock is disclosed. The sleeve comprises a plurality of stretchable slots 85 and/or slits 90 (depicted in FIGS. 11 and 12) on an inner surface of the sleeve having a diameter less than or equal to an outer diameter of the shaft. The slots 85 and/or slits 90 are configured to allow the sleeve to elastically stretch like an accordion to fit a wide range of arrow shaft diameters. Six slots are depicted in addition to the slots or channels which intersect glue holes or portals but any number of slots may be formed in the fletching sleeve to give it more stretchability. A portion of the sleeve over the slot/slits 25 may form a raised rib protrusion on an outside surface of the sleeve 10 in order to maintain a constant thickness of the sleeve 10 over the slots/slits. The slots/slits are configured to form a plurality of stretch areas between a sleeve area above each slot/slit and another area of the sleeve, the stretch areas configured to lower an overall stretch resistance of the sleeve to facilitate an application of the sleeve onto the arrow shaft (not depicted).

An embodiment of the archery fletching sleeve may further comprise a plurality of circumferential slots/slits on the inner surface of the sleeve, the circumferential slots/slits configured to be concentric with a center defined in an interior of the sleeve.

The slots/slits may comprise a depth of (5 thousandths of an inch) 0.13 mm to (10 thousandths of an inch) 0.25 mm and a width of (one thousandths of an inch) 0.03 mm thus configured to form an accordion billows able to draw a cyanoacrylate glue across a length of (1.75 inches) 44.5 mm against the force of gravity. A length of a slot/slit may extend from a first end of the sleeve to a second end of the sleeve and the length is nominally (1.75 inches) 44.5 mm including one of a ten percent plus and a ten percent minus manufacturing tolerance.

Another embodiment of the archery fletching sleeve with integral vanes configured to fit around an arrow shaft in a fixed position with respect to an end of the shaft with a nock, further comprises at least one adhesive application portal therein, wherein a ratio of portal area to sleeve surface area is one part in at least 110 parts sleeve surface area, the portal(s) configured to receive an adhesive applied to the arrow shaft at the portal(s).

Figure 10:
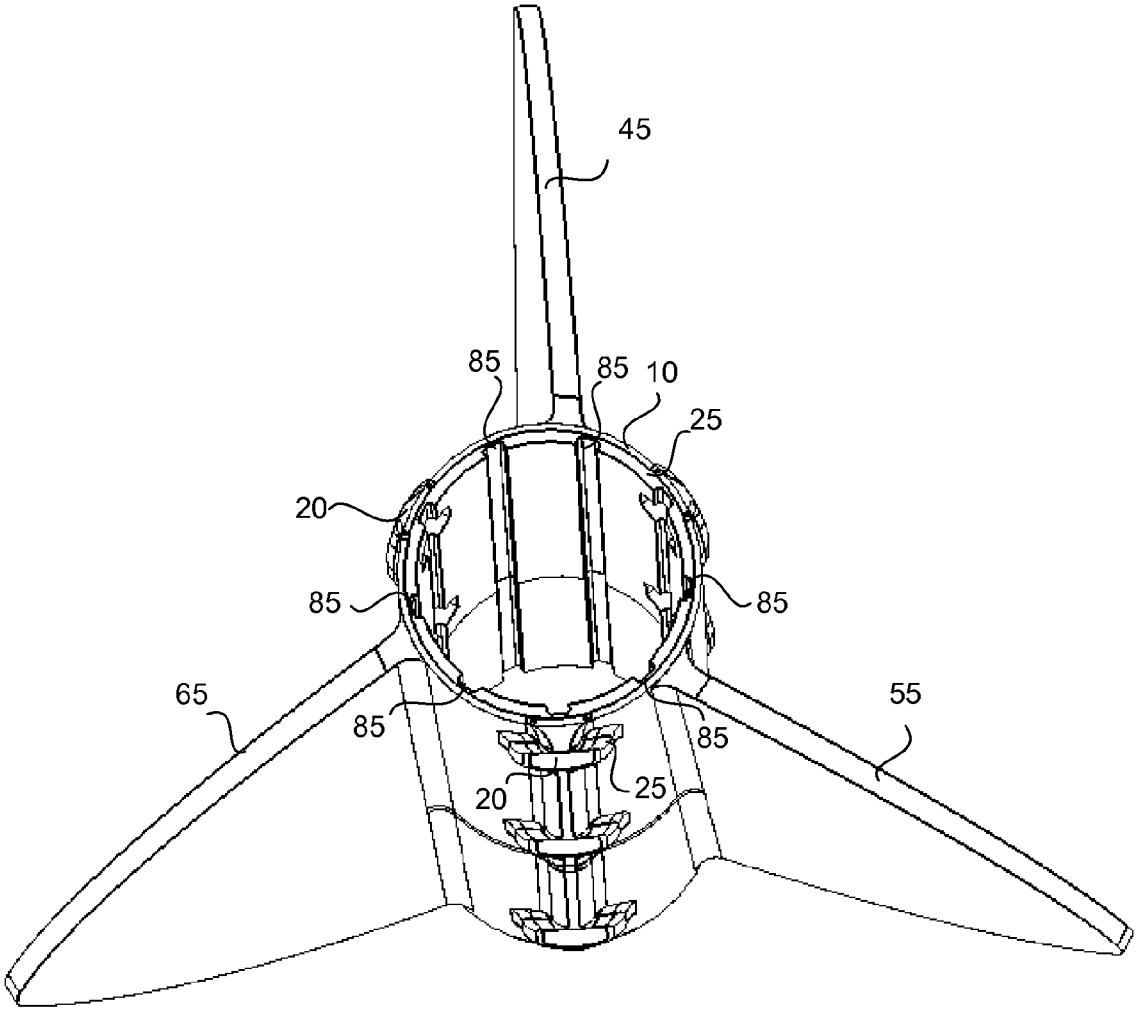
FIG. 10 depicts an end perspective view of an archery fletching sleeve including 6 slots in addition to 3 glue channels in accordance with an embodiment of the present disclosure.

FIG. 10 depicts an end perspective view of an archery fletching sleeve including 6 slots in addition to 3 glue channels in accordance with an embodiment of the present disclosure. Reference numbers similar or same to reference numbers in other drawings are used to identify similar or same elements as also described in supporting descriptions. Here it is clearly shown that the slots 85 may extend the entire length of the archery fletching sleeve 10. Glue may be applied to either end of the slot 85 at the sleeve ends in order to be drawn into a channel formed with the arrow shaft (not depicted). A capillary effect or an accordion pumping action, gravity, etc. may be used to draw the glue into the channel as claimed and explained further below. The slots and/or slits may also be configured to interconnect a plurality of glue holes defined in the sleeve, the slots/slits configured to form channels with the arrow shaft and draw a glue applied to the holes through the slots via an accordion pumping action in the formed channels.

Figure 11:
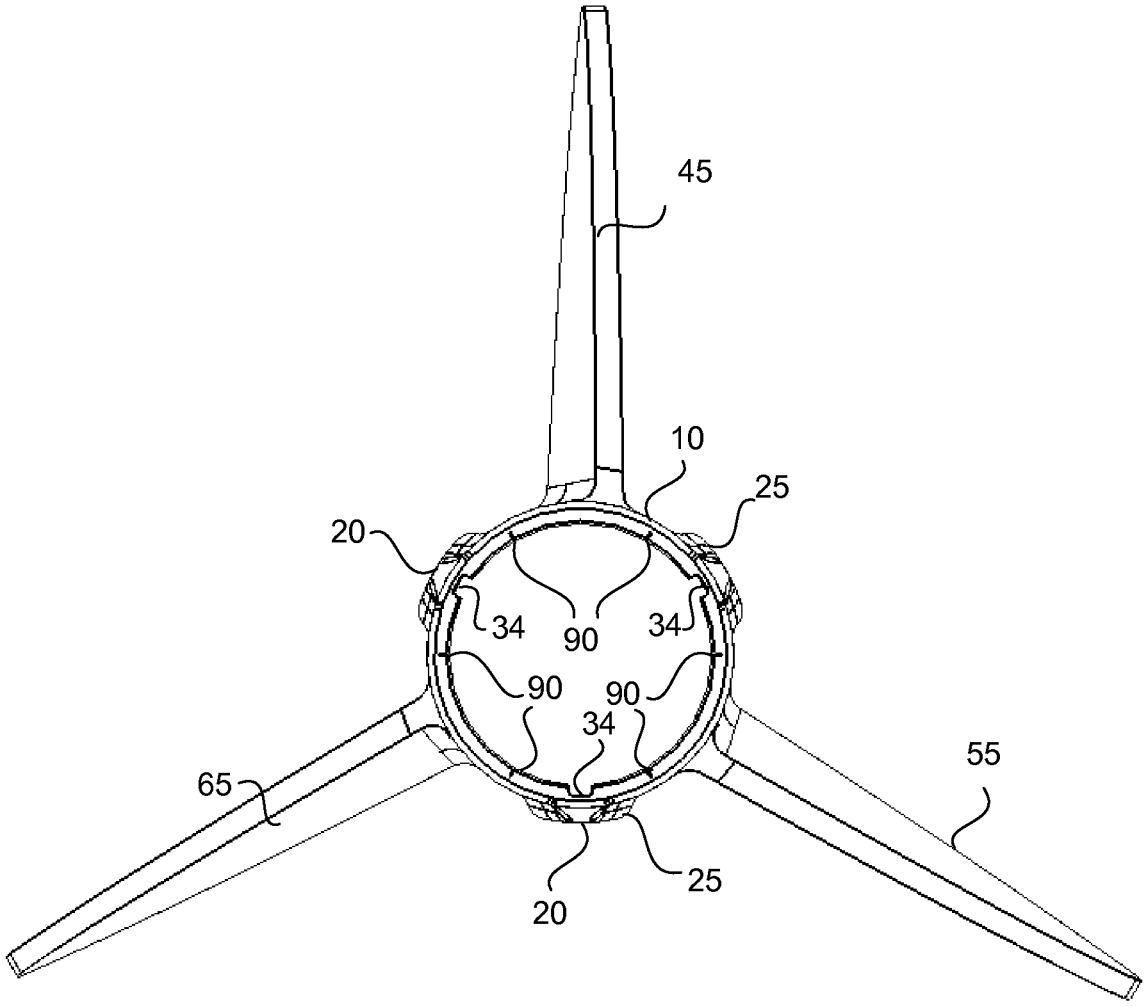
FIG. 11 depicts an end elevational view of an archery fletching sleeve including 6 slits in addition to 3 glue channels in accordance with an embodiment of the present disclosure.

FIG. 11 depicts an end elevational view of an archery fletching sleeve including 6 slits in addition to 3 glue channels in accordance with an embodiment of the present disclosure.

With the exception of the slits 90, reference numbers similar or same to reference numbers in other drawings are used to identify similar or same elements as also described in supporting descriptions. The dimensions of the stretch slots 85 and the glue channels 30 may be similar or the same and therefore any distinction between the two as referenced herein may depend on the respective embodiment and/or use thereof. In fact, a very narrow slot 85 may be referred to as a slit 90 and therefore the terms may be used interchangeably.

Figure 12:
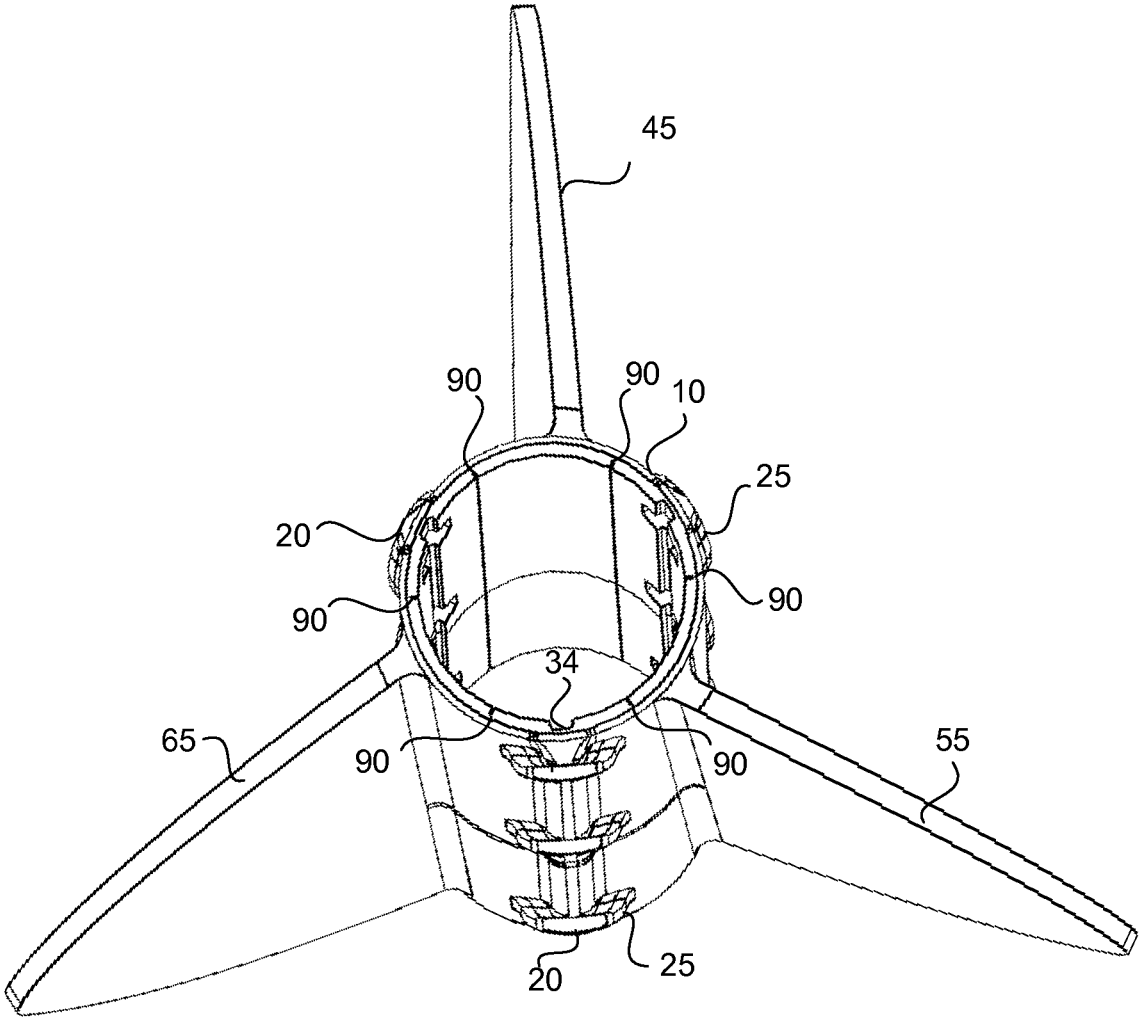
FIG. 12 depicts an end perspective view of an archery fletching sleeve including 6 slits in addition to 3 glue channels in accordance with an embodiment of the present disclosure.

FIG. 12 depicts an end perspective view of an archery fletching sleeve including 6 slits in addition to 3 glue channels in accordance with an embodiment of the present disclosure. Reference numbers similar or same to reference numbers in other drawings are used to identify similar or same elements as also described in supporting descriptions. Here it is clearly shown that the slits 90 may extend the entire length of the archery fletching sleeve 10. The slits 90 may not draw a glue applied thereto as well as a larger slot 90 and therefore may be primarily for stretchability of the sleeve. However, many more slits 90 than shown may therefore be formed in the underside of the fletching sleeve to increase its stretchability.

Figure 13A:
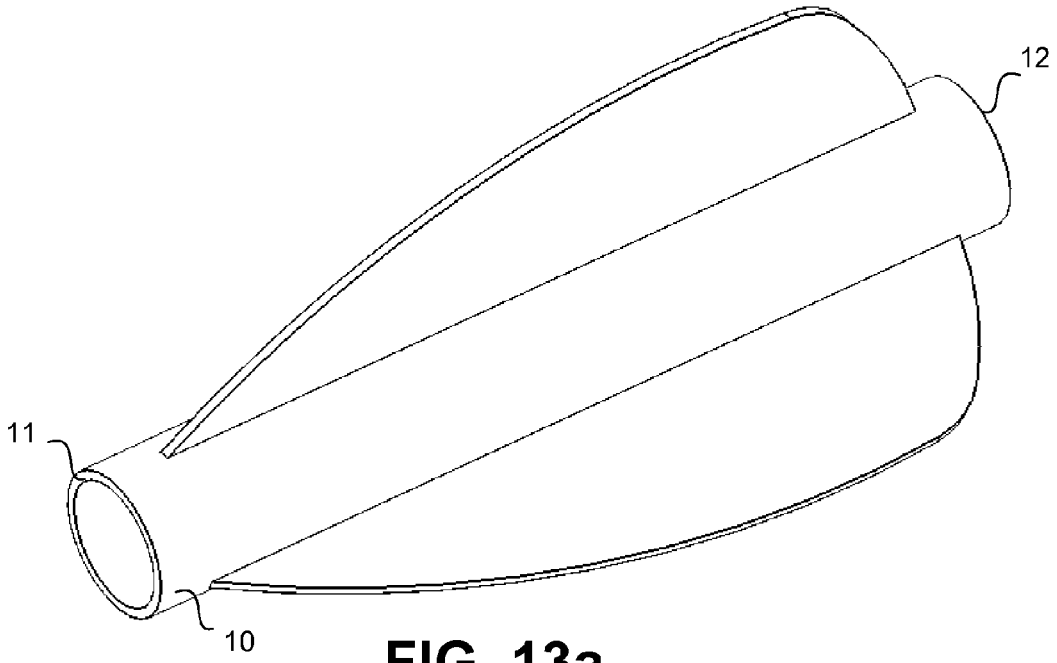
FIG. 13*a* depicts a perspective view of an archery fletching sleeve with a front end and a back end in accordance with an embodiment of the present disclosure.

FIG. 13*a* depicts a perspective view of an archery fletching sleeve with a front end and a back end in accordance with an embodiment of the present disclosure. Reference numbers similar or same to reference numbers in other drawings are used to identify similar or same elements as also described in supporting descriptions. The front end 11 of the archery fletching sleeve is depicted in relation to the back end 12 of the archery fletching sleeve. The front end 11 may be closer to the arrow tip and the back end 12 closer to the arrow nock in relation to each other.

Figure 13B:
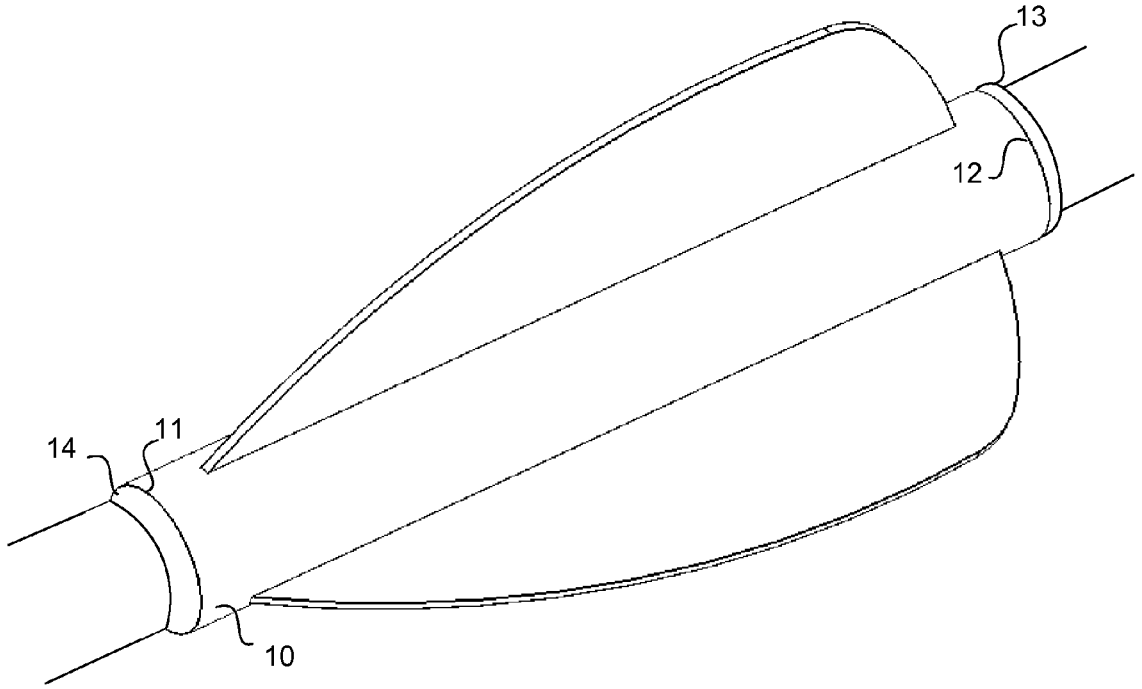
FIG. 13*b* depicts a perspective view of an archery fletching sleeve with a front glue bead and a back glue bead in accordance with an embodiment of the present disclosure.

FIG. 13*b* depicts a perspective view of an archery fletching sleeve with a front glue bead and a back glue bead in accordance with an embodiment of the present disclosure. Reference numbers similar or same to reference numbers in other drawings are used to identify similar or same elements as also described in supporting descriptions. The depicted archery fletching sleeve 10 with integral vanes is configured to fit around an arrow shaft in a fixed position with respect to an end of the shaft with a nock. The sleeve comprises a ratio of an area of an adhesive applied to the sleeve adjacent the arrow shaft to be one part in at least 18.4 parts sleeve surface area. The adhesive may be applied to a back end 12 to create a back end bead 13 and applied to a front end 11 to create a front bead 14. A front end bead 14 applied to only the front end 11 may be sufficient to secure the fletching sleeve onto the arrow shaft. However, Adhesive applied to both the front end 11 and the backend 12 to create beads 14 and 13 respectively may enhance durability.

Figure 14:
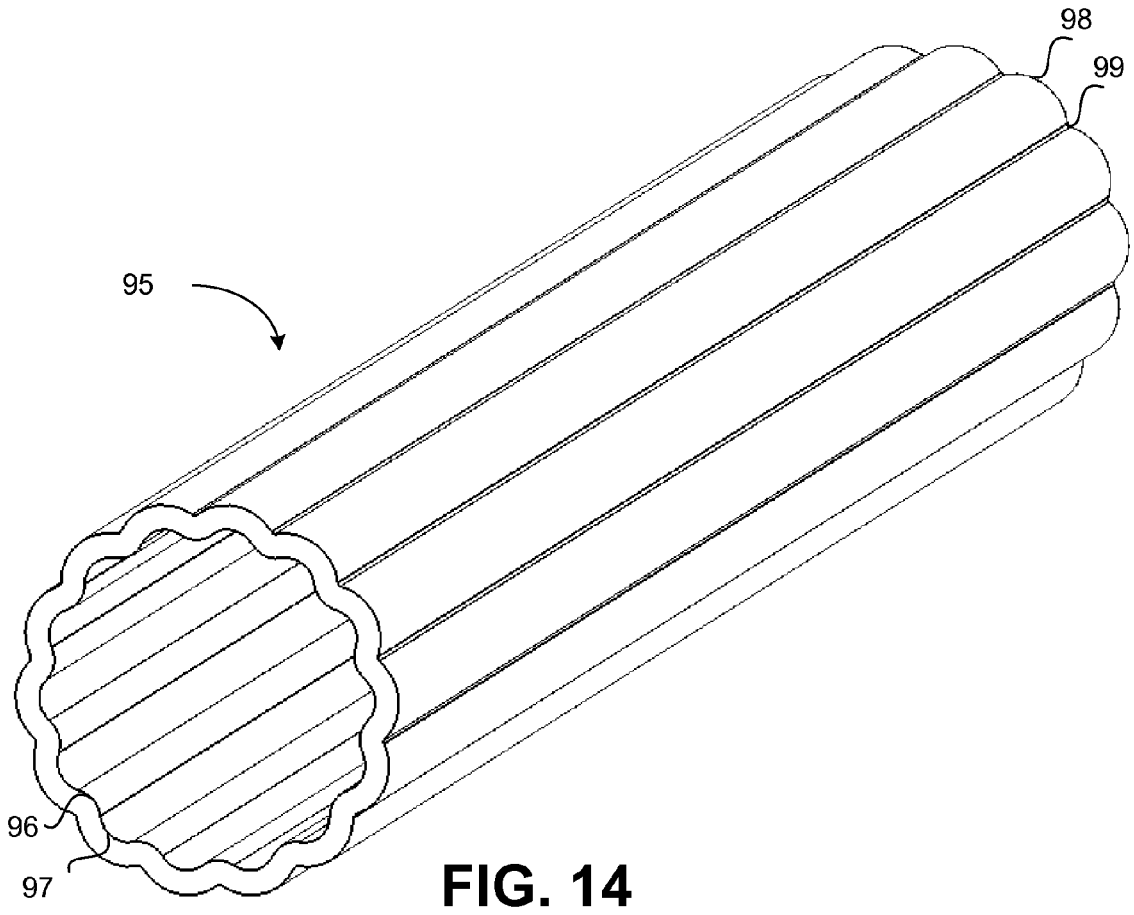
FIG. 14 depicts a perspective view of an accordion corrugated archery fletching sleeve in accordance with an embodiment of the present disclosure.

FIG. 14 depicts a perspective view of an accordion corrugated archery fletching sleeve in accordance with an embodiment of the present disclosure. Reference numbers similar or same to reference numbers in other to drawings are used to identify similar or same elements as also described in supporting descriptions. The accordion-like corrugated archery fletching sleeve 95 may also include integral vanes and be configured to fit around an arrow shaft in a fixed position with respect to an end of the shaft with a nock. The fletching sleeve 95 may comprise a stretchable corrugated sleeve body having an outer diameter tangential to an outer surface of a plurality of alternating longitudinal ridges 98 thereon and an inner diameter tangential to an inner surface of a plurality of alternating longitudinal ridges 96 thereon, the inner diameter configured to be variable to stretchably fit the arrow shaft having a diameter greater than and/or equal to the sleeve inner diameter. An outer surface ridge 98 may form a corresponding wall to an inner surface groove 97. Alternatively, an inner surface ridge 96 may form a corresponding wall to an outer surface groove 99.

Figure 15:
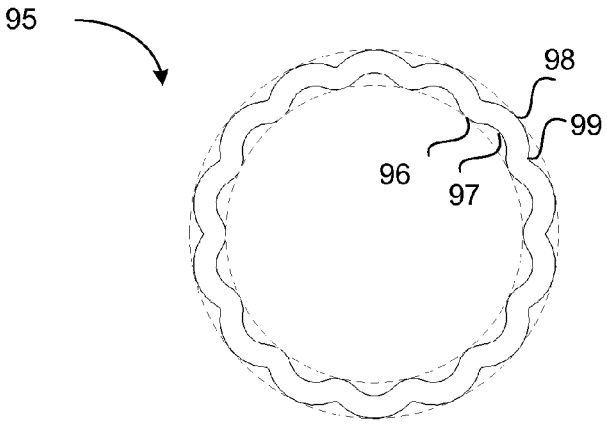
FIG. 15 depicts an end elevational view of an accordion corrugated archery fletching sleeve in accordance with an embodiment of the present disclosure.

FIG. 15 depicts an end elevational view of an accordion corrugated archery fletching sleeve in accordance with an embodiment of the present disclosure. Reference numbers similar or same to reference numbers in other drawings are used to identify similar or same elements as also described in supporting descriptions. Here the outer diameter tangential to an outer surface of a plurality of alternating longitudinal ridges 98 is drawn in broken lines. Also, the inner diameter tangential to an inner surface of a plurality of alternating longitudinal ridges 96 is depicted in broken lines. The inner diameter is configured to be variable to stretchably fit an arrow shaft having a diameter greater than and/or equal to the fletching sleeve inner diameter.

An embodiment of the disclosure may further comprise at least one non-vane protrusion extending from the fletching sleeve, a protrusion height thereof being greater than one fourth a thickness of the fletching sleeve thickness.

Figure 16:
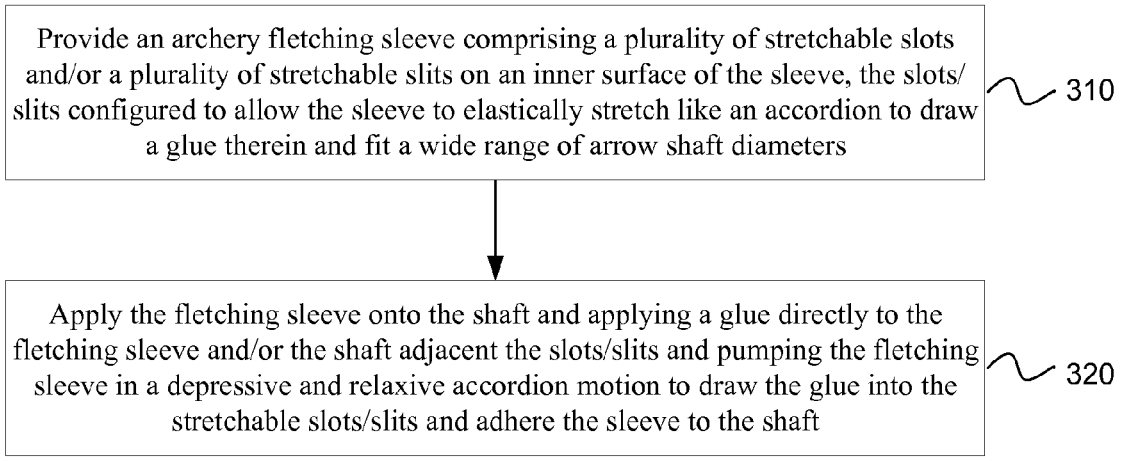
FIG. 16 depicts a flow chart of a method of application of the fletching sleeve via a pumping motion to draw glue into the slots of the fletching sleeve in accordance with an embodiment of the present disclosure.

FIG. 16 depicts a flow chart of a method of application of the fletching sleeve via a pumping motion to draw glue into the slots of the fletching sleeve in accordance with an embodiment of the present disclosure. The method comprises 310 providing an archery fletching sleeve including a plurality of stretchable slots and/or a plurality of stretchable slits on an inner surface of the sleeve, the slots/slits configured to allow the sleeve to elastically stretch like an to accordion to draw a glue therein and fit a wide range of arrow shaft diameters. The method also includes 320 applying the fletching sleeve onto the shaft and applying a glue directly to the fletching sleeve and/or the shaft adjacent the slots/slits and pumping the fletching sleeve in a depressive and relaxive accordion motion to draw the glue into the stretchable slots/slits and adhere the sleeve to the shaft.

Figure 17:
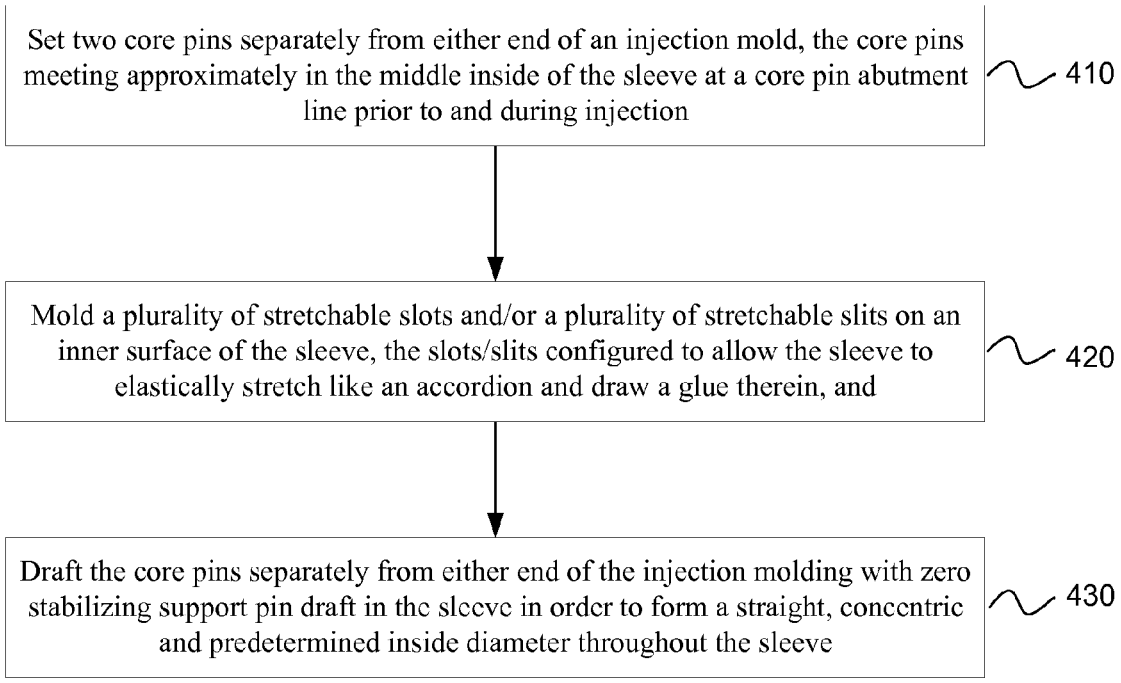
FIG. 17 depicts a flow chart of a method of manufacture of a one piece archery fletching sleeve in accordance with an embodiment of the present disclosure.

FIG. 17 depicts a flow chart of a method of manufacture of a one piece archery fletching sleeve in accordance with an embodiment of the present disclosure. The method includes 410 setting two core pins separately from either end of an injection mold, the core pins meeting approximately in the middle inside of the sleeve at a core pin abutment line prior to and during injection. The method also includes 420 molding a plurality of stretchable slots and/or a plurality of stretchable slits on an inner surface of the sleeve, the slots/slits configured to allow the sleeve to elastically stretch like an accordion and draw a glue therein. The method further includes 430 drafting the core pins separately from either end of the injection molding with zero stabilizing support pin draft in the sleeve in order to form a straight, concentric and predetermined inside diameter throughout the sleeve.

Embodiments of the fletching sleeve 10 may be manufactured using a co-extrusion process with two materials, or through a two shot injection mold process, or even an over mold injection mold process. Two core pins may be used to form the disclosed fletching sleeve in order to form an optimal inside sleeve diameter. Manufacturing via a single core pin may cause concentric issues with the sleeve diameter and may require support pins through the sleeve 10 to help stabilize the core pin. Therefore, a dual pin method of manufacturing enables forming a straighter sleeve 10 because the two core pins may meet approximately in the middle inside of the sleeve at the core pin abutment line 15 and may be separately set prior to and during injection. A two pin method of manufacturing as disclosed also facilitates draft, or the removing of the fletching sleeve 10 from the injection mold. This element of the disclosure is particularly helpful in rapid injection molding manufacturing.

An inside diameter of the fletching sleeve may be greater than an outside diameter of the arrow shaft to which it is affixed and therefore facilitate sliding the sleeve onto the shaft. Embodiments having an inside diameter of the arrow sleeve smaller than an outside diameter of the arrow shaft may also be included in embodiments of the disclosure allowing for frictional fit of the sleeve via stretch sutures onto the arrow shaft as disclosed herein. The actual difference in diameters may be very small in order to allow for manufacturing tolerances approximating an equivalence thereof.

A method of producing or manufacturing an archery vane is also embodied herein using a two shot, over mold, or co-extrusion to produce a different color cock vane. Where there are three vanes on an arrow, two of them may be one color and the third (cock vane) a different color to aid in clocking the arrow properly on the bowstring. Also, an embodied process may injection mold a number of colors at one time causing a mixing camouflage type pattern. A hydrographic process also allows dipping different patterns onto thermo plastic elastomers and thermo plastic urethanes.

An embodiment of the disclosure may include a center sleeve with features that make it more flexible to allow expansion over a wide range of shaft diameters and allow harder and tougher vane material for durability. An embodiment also may include a small diameter carbon shaft that is glued into the back of an arrow so that a one piece vane can be installed with a flush fit with the main diameter of the arrow shaft. Also, a cone style installation tool may be included in an embodiment that may replace the nock in the end of an arrow temporally while the vane is installed.

Embodied methods of application may also include an air hose adaptor for installing fletching onto shaft. A custom air hose adaptor may allow easy installation of a smaller diameter one piece fletching over a larger arrow shaft. Another embodied method may include attaching a one piece fletching to arrow shafts comprising double sided tape, and solvent. Other embodiments may comprise spraying an arrow shaft with aerosol hairspray which acts as a lubricant for a short period of time, while the fletching is installed over the shaft. Thereafter the hairspray dries and bonds the fletching to the arrow. Talcum powder may also be applied to the arrow and the vane to aid in application or installation. Yet another method of application may include inserting a needle glue applicator under the sleeve while the sleeve is on the arrow shaft.

An embodiment of the present disclosure may include laying down a spherical or cylindrical bead of glue around the shaft and sliding the fletching sleeve onto or adjacent the bead of glue. A first bead of glue may also be applied adjacent a first end of the sleeve and a second bead of glue may also be applied adjacent a second end of the sleeve on the arrow shaft. The glue portals 34 formed at the end of a fletching sleeve by a slot or channel therein are configured to draw glue from the bead of glue at either end of the fletching sleeve into and through the slots and channels formed with the arrow shaft. The embodiment thusly described may not therefore require additional glue holes between ends of the fletching sleeve in order to secure the fletching sleeve to the arrow shaft. The glue or adhesive may also be applied responsive to the sleeve being positioned in a predetermined location on the arrow shaft and secure the fletching sleeve onto the arrow shaft for certain applications in spite of glue in the channels thereof.

Although the operations of the method(s) herein are shown and described in a particular order, the order of the operations of each method may be altered so that certain operations may be performed in an inverse order or so that certain operations may be performed, at least in part, concurrently with other operations. In another embodiment, instructions or sub-operations of distinct operations may be implemented in an intermittent and/or alternating manner.

Notwithstanding specific embodiments of the invention have been described and illustrated, the invention is not to be limited to the specific forms or arrangements of parts so described and illustrated. The scope of the invention is to be defined by the claims and their equivalents to be included by reference in a non-provisional utility application.

What is claimed is:

1. An archery fletching sleeve with integral vanes configured to fit around an arrow shaft in a fixed position with respect to an end of the shaft with a nock, the sleeve comprising a plurality of stretchable slots and/or slits on an inner surface of the sleeve having a diameter less than or equal to an outer diameter of the shaft, the slots and/or slits configured to allow the sleeve to elastically stretch like an accordion to fit a wide range of arrow shaft diameters.

2. The archery fletching sleeve of claim 1, wherein a ratio of a slot/slit height to a vane height is 1 part slot/slit height to 60 parts vane height plus or minus a manufacturing tolerance of 10%.

3. The archery fletching sleeve of claim 1, wherein a portion of the sleeve over the slot/slits forms a raised rib protrusion on an outside surface of the sleeve in order to maintain a constant thickness of the sleeve over the slots/slits.

4. The archery fletching sleeve of claim 1, wherein the slots/slits are configured to form a plurality of stretch areas between a sleeve area above each slot/slit and another area of the sleeve, the stretch areas configured to lower an overall stretch resistance of the sleeve to facilitate an application of the sleeve onto the arrow shaft.

5. The archery fletching sleeve of claim 1, further comprising a plurality of glue holes defined in the sleeve wherein a slot/slit is formed one of adjacent a glue hole and formed concentric with a glue hole.

6. The archery fletching sleeve of claim 1, further comprising at least 3 vanes longitudinally attached to the sleeve, one of the vanes comprising a recess configured to receive one of a sticker and a graphic plate.

7. The archery fletching sleeve of claim 1, further comprising the slots/slits configured to interconnect a plurality of glue holes defined in the sleeve, the slots/slits configured to form channels with the arrow shaft and draw a glue applied to the holes through the slots via an accordion pumping action in the formed channels.

8. The archery fletching sleeve of claim 1, further comprising a plurality of circumferential slots/slits on the inner surface of the sleeve, the circumferential slots/slits concentric with a center defined in an interior of the sleeve.

9. The archery fletching sleeve of claim 1, wherein the slots/slits comprise a depth of (5 thousandths of an inch) 0.13 mm to (10 thousandths of an inch) 0.25 mm and a width of (one thousandths of an inch) 0.03 mm thus configured to form an accordion billows able to draw a cyanoacrylate glue across a length of (1.75 inches) 44.5 mm against the force of gravity.

10. The archery fletching sleeve of claim 1, wherein a length of a slot/slit extends from a first end of the sleeve to a second end of the sleeve and the length is nominally (1.75 inches) 44.5 mm including one of a ten percent plus and a ten percent minus manufacturing tolerance.

11. The archery fletching sleeve of claim 1, wherein the slots/slits comprise one configuration of substantially orthogonal internal vertices and another semi-circular configuration with no vertices and any other slot-like configuration.

12. The archery fletching sleeve of claim 1, further comprising an adhesive application portal formed at an end of the fletching sleeve adjacent a slot/slit therein comprising raised portions configured to protrude above an outside diameter of the sleeve and receive and contain the adhesive for application onto the arrow shaft.

13. The archery fletching sleeve of claim 1, further comprising a plurality of longitudinal vanes, wherein the vanes are one of attached to the sleeve and formed as an integral part of the sleeve, the vanes further configured to be one of offset from an elongate axis of the sleeve and formed in-line with the elongate axis of the sleeve, the offset axis configured to impart an aerodynamic spin to the arrow in flight.

14. The archery fletching sleeve of claim 1, wherein a ratio of a slot/slit height to a sleeve thickness/height is 1 part slot height to 3 parts sleeve thickness/height plus or minus a manufacturing tolerance of 10%.

15. The archery fletching sleeve of claim 1, wherein an adhesive application portal formed at an end of the fletching sleeve by a slot/slit therein is configured to draw glue from a bead of glue disposed around the end of the fletching sleeve into and through the slots formed with the arrow shaft.

16. The archery fletching sleeve of claim 1, further comprising a ratio of an area of the adhesive applied to the arrow shaft at the portal(s) to be at least one part in 18.4 parts sleeve surface area.

17. An archery fletching sleeve with integral vanes configured to fit around an arrow shaft in a fixed position with respect to an end of the shaft with a nock, the fletching sleeve comprising a stretchable corrugated sleeve body having an outer diameter tangential to an outer surface of a plurality of alternating longitudinal ridges thereon and an inner diameter tangential to an inner surface of a plurality of alternating longitudinal grooves thereon, the inner diameter configured to be variable to stretchably fit the arrow shaft having a diameter greater than and/or equal to the sleeve inner diameter.

18. The archery fletching sleeve of claim 17, further comprising at least one non-vane protrusion extending from the fletching sleeve, a protrusion height thereof being greater than one fourth a thickness of the fletching sleeve thickness.

* * * * *